US009420876B2

(12) United States Patent
Biagi

(10) Patent No.: US 9,420,876 B2
(45) Date of Patent: Aug. 23, 2016

(54) SCRAPER BROOM

(75) Inventor: Daniel Biagi, Eugene, OR (US)

(73) Assignee: SANI PRODUCTS, INC., Eugene, OR (US)

( * ) Notice: Subject to any disclaimer, the term of this patent is extended or adjusted under 35 U.S.C. 154(b) by 111 days.

(21) Appl. No.: 14/232,946

(22) PCT Filed: Jul. 13, 2012

(86) PCT No.: PCT/US2012/046683

§ 371 (c)(1),
(2), (4) Date: Jan. 15, 2014

(87) PCT Pub. No.: WO2013/012728

PCT Pub. Date: Jan. 24, 2013

(65) Prior Publication Data

US 2014/0150194 A1 Jun. 5, 2014

Related U.S. Application Data

(60) Provisional application No. 61/508,458, filed on Jul. 15, 2011.

(51) Int. Cl.

| | |
|---|---|
| ***A47L 13/12*** | (2006.01) |
| ***A46B 17/08*** | (2006.01) |
| ***A47L 13/08*** | (2006.01) |
| *A46B 15/00* | (2006.01) |

(52) U.S. Cl.

CPC ..... *A46B 17/08* (2013.01); *A47L 13/08* (2013.01); *A47L 13/12* (2013.01); *A46B 15/0081* (2013.01); *A46B 2200/302* (2013.01)

(58) Field of Classification Search

CPC ..... A46B 15/0081; A46B 15/0055; A47L 13/02; A47L 13/12

USPC ..... 15/111, 144.4

See application file for complete search history.

(56) References Cited

U.S. PATENT DOCUMENTS

| | | | |
|---|---|---|---|
| 597,246 | A | 1/1898 | Pratt |
| 950,012 | A | 2/1910 | Bender |
| 2,163,979 | A | 6/1939 | Judson |
| 2,290,178 | A | 7/1942 | Hayford |
| 2,687,542 | A | 8/1954 | Turausky |
| 2,741,788 | A | 4/1956 | Shey |
| 3,084,369 | A | 4/1963 | Hawkins |
| 3,733,636 | A | 5/1973 | Osadsky |
| 4,785,489 | A | 11/1988 | Von Doehren |
| D315,975 | S | 4/1991 | Huang |

(Continued)

FOREIGN PATENT DOCUMENTS

| | | | | |
|---|---|---|---|---|
| GB | 2150015 | A | 6/1985 | |
| JP | 2002-125902 | * | 5/2002 | ..... A47L 13/08 |

OTHER PUBLICATIONS

Computer generated English translation of JP 2002-125902, May 2002, Yamada.*

(Continued)

*Primary Examiner* — Laura C Guidotti

(74) *Attorney, Agent, or Firm* — Abelman, Frayne & Schwab

(57) ABSTRACT

A scraper broom integrates an elongated handle with a fixed scraper element attached thereto and a displaceable broom head. The displaceable broom is movable between a first position and a second position for conversion of the device from a broom to a scraper.

15 Claims, 11 Drawing Sheets

(56) References Cited

U.S. PATENT DOCUMENTS

| | | | |
|---|---|---|---|
| 5,123,138 | A | 6/1992 | Flamm |
| 5,309,654 | A | 5/1994 | Mathis |
| D355,075 | S | 2/1995 | Stone |
| 5,502,857 | A | 4/1996 | Jubinville |
| D391,714 | S | 3/1998 | Kilander |
| 5,839,145 | A | 11/1998 | Petner |
| D403,865 | S | 1/1999 | Packer |
| 5,870,794 | A | 2/1999 | Harpell |
| 6,038,794 | A | 3/2000 | Kilander |
| 6,311,368 | B1 | 11/2001 | Sartori |
| 6,353,960 | B1 | 3/2002 | Jannicelli, Jr. |
| D468,106 | S | 1/2003 | Robertson |
| 6,606,756 | B2 | 8/2003 | Fernandez |
| 6,804,853 | B2 * | 10/2004 | Wang ..... A47L 13/258 15/105 |
| 7,107,644 | B1 | 9/2006 | Bahl, Jr. |
| 7,695,036 | B2 | 4/2010 | Smetana |
| D617,158 | S | 6/2010 | Smith |
| 2005/0132517 | A1 * | 6/2005 | Weckemann ..... A46B 17/02 15/111 |
| 2010/0102584 | A1 * | 4/2010 | Sanchez ..... B25G 1/04 294/51 |
| 2012/0030089 | A1 * | 2/2012 | Ram ..... G06Q 30/0222 705/37 |

OTHER PUBLICATIONS

PCT/US2012/046683, International Search Report and Written Opinion, Oct. 5, 2012, 7 pages.

* cited by examiner

SCRAPER BROOM

RELATED APPLICATIONS

The present application is a national phase application under 35 U.S.C. §371 of PCT/US2012/046683 filed on Jul. 13, 2012, which claims the benefit of U.S. Provisional Patent Application No. 61/508,458 filed no Jul. 15, 2011, the disclosures of which are incorporated herein by reference in their entireties.

BACKGROUND OF THE INVENTION

1. Field of the Invention

The present invention relates to cleaning tools, and in particular to integrated sweeping brooms and scrapers.

2. Description of Related Art

There exists numerous designs for brooms and other tools for cleaning indoor and outdoor ground surfaces. Certain devices are described in the following patent documents: USD617158S1; USD468106S1; USD403865S1; USD391714S1; USD355075S1; USD315975S1; U.S. Pat Nos. 950,012A; 7,695,036B2; 7,107,644B1; 6,353,960B1; 6,038,794A; 597,246A; 5,870,794A; 5,839,145A; 5,502,857A; 5,309,654A; 5,123,138A; 4,785,489A; 3,733,636A; 3,084,369A; 2,741,788A; 2,687,542A; 2,290,178A; 2,163,979A; GB2150015A.

Recently there has been described a proposed integrated broom and scraper known as the "SweepEasy™" in which a scraper is integrated on a telescoping pole that extends and retracts from a broom handle having a fixed broom head.

Nonetheless, there remains a need in the art for improved integrated sweeping brooms and scrapers, in particular when used in with a level of force that can cause conventional scraper assemblies to fail.

SUMMARY OF THE INVENTION

In accordance with one or more embodiments, the invention relates to a scraper broom including a handle and fixed scraper, and a displaceable broom head.

The scraper broom integrates an elongated handle which included a scraper element attached at a distal end thereof, and a displaceable broom head. The displaceable broom head has bristles extending therefrom and is movable between a first position in which the bristles substantially surround and extend beyond the scraper element, and a second position in which the scraper element is exposed substantially without obstruction from the bristles.

Accordingly, the displaceable broom head slides or otherwise articulates relative to the fixed scraper element to reveal the scraper element that is integral with the elongated handle. Advantageously, since the scraper can be subjected to both a greater force magnitude and a greater variety of force vectors, in contrast to the use of a sweeping broom for its ordinary purpose whereby the broom head and bristles are subjected to lesser magnitude force and less variety of force vectors, the herein device is more durable and reliable than conventionally known integrated floor sweeping/scraping devices.

BRIEF DESCRIPTION OF THE DRAWINGS

The foregoing summary as well as the following detailed description of preferred embodiments of the invention will be best understood when read in conjunction with the attached drawings. It should be understood, however, that the invention is not limited to the precise arrangements and apparatus shown. In the drawings the same or similar reference numeral is used to identify to the same or similar elements, in which.

DETAILED DESCRIPTION OF THE INVENTION

In general, a scraper broom integrates an elongated handle with a fixed scraper element attached thereto and a displaceable broom head. The displaceable broom is movable between a first position and a second position for conversion of the device from a broom to a scraper.

Figure 1:
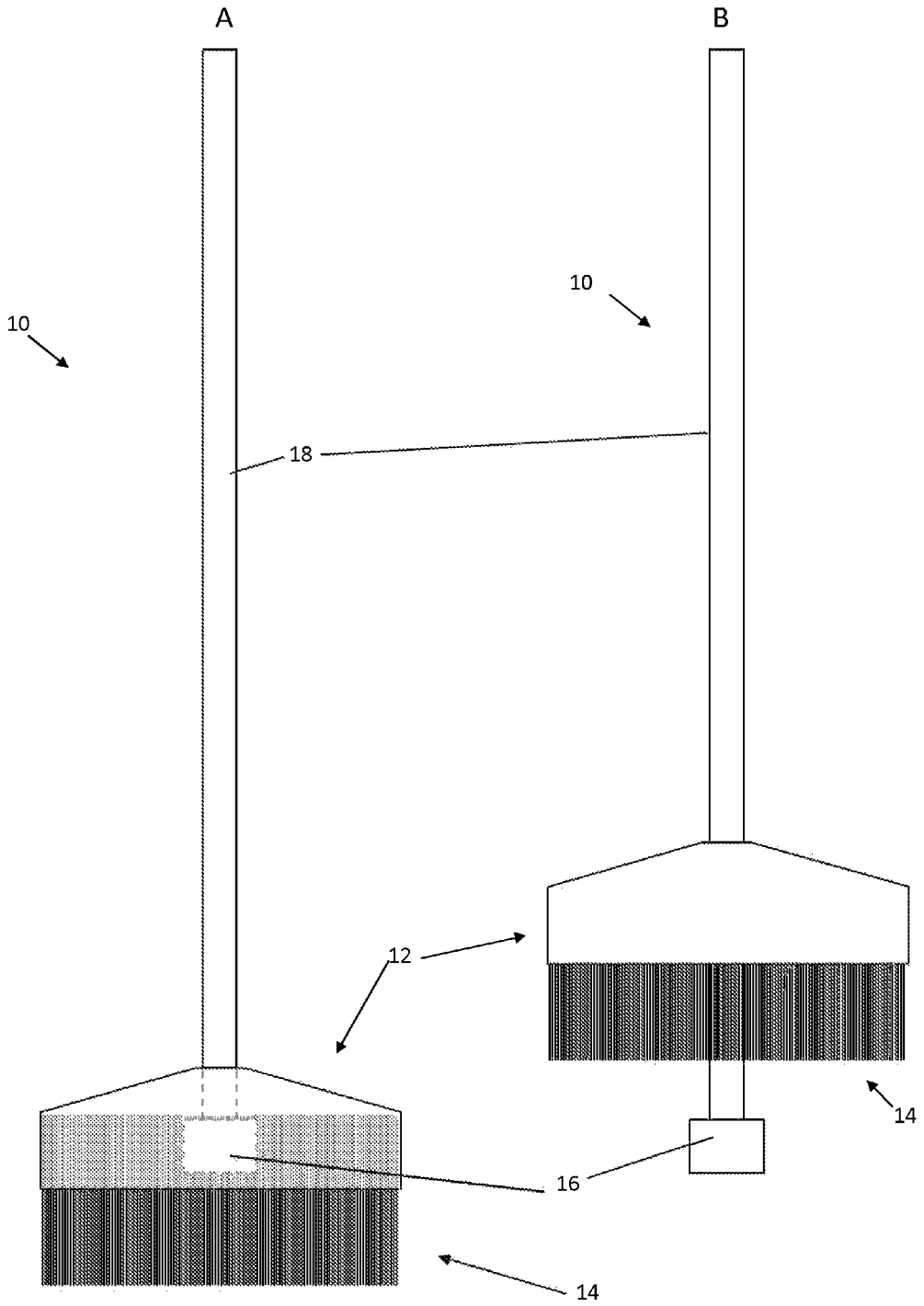
FIG. 1 depicts a pair of views of a scraper broom described herein.

Referring to FIG. 1, a scraper broom 10 is shown that comprises a displaceable broom head 12 having bristles 14 extending therefrom, and a scraper element 16 integral with a handle 18. In general, the displaceable broom head 12 is movable between a first position in which the bristles 14 substantially surround and extend beyond the scraper element 16 (as shown in view "A") and a second position in which the scraper element 16 is exposed substantially without obstruction from the bristles 14 (as shown in view "B").

The displaceable broom head 12 slides or otherwise articulates relative to the fixed scraper element 16 to reveal the scraper element 16 that is integral with the elongated handle 18. In contrast to a structure in which a scraper is displaced, significant structural advantages are attained by the present invention. When used by an individual, the scraper is subjected to both a greater force magnitude and a greater variety of force vectors, in contrast to the use of a sweeping broom for its ordinary purpose whereby the broom head and bristles are subjected to lesser magnitude force and less variety of force vectors.

Described herein are various non-limiting examples of locking apparatus and other structures for displacing the broom head relative to the scraper element integral and fixed with respect to the handle. The locking apparatus can be a suitable mechanical assemblage that permits locking and unlocking using only an individuals' hands (or single handed operation), or a foot-operated action. Locking and unlocking is to be based on an action from the user that does not require tools or any special skills. Various locking mechanisms will be apparent to one of ordinary skill in the art.

Examples of suitable mechanical assemblages suitable to lock the broom head into the necessary positions and/or displace or articulate the broom head include, but are not limited to:

a friction fit;

a lock-type twist grip (e.g., similar to that used in Total Reach Model 961810 telescoping pole);

a threaded grip (e.g., similar to that used in Unger Pro Model-962720 telescoping pole); a clip grip (e.g., having one or more clips accessible to the user on the broom post engaging receiving portions of the broom handle);

a push lock (e.g., similar to that used in Shur Line Extension Pole Model 06570L); and a mechanism similar to that used in roller mops (e.g., similar to that used in the Libman model 02016 roller mop), in which any components that extend from the center of the conventional roller mop are either on the outside of the neck portion of the broom head, or between the neck portion of the broom head and the scraper handle.

In particular, the scraper broom described herein functions like a normal broom when locked in the broom position (view "A"), and can be quickly converted and locked into the scraper position (view "B") for scraping dried debris, such as food or dirt, from hard surface floors.

Figure 2A:
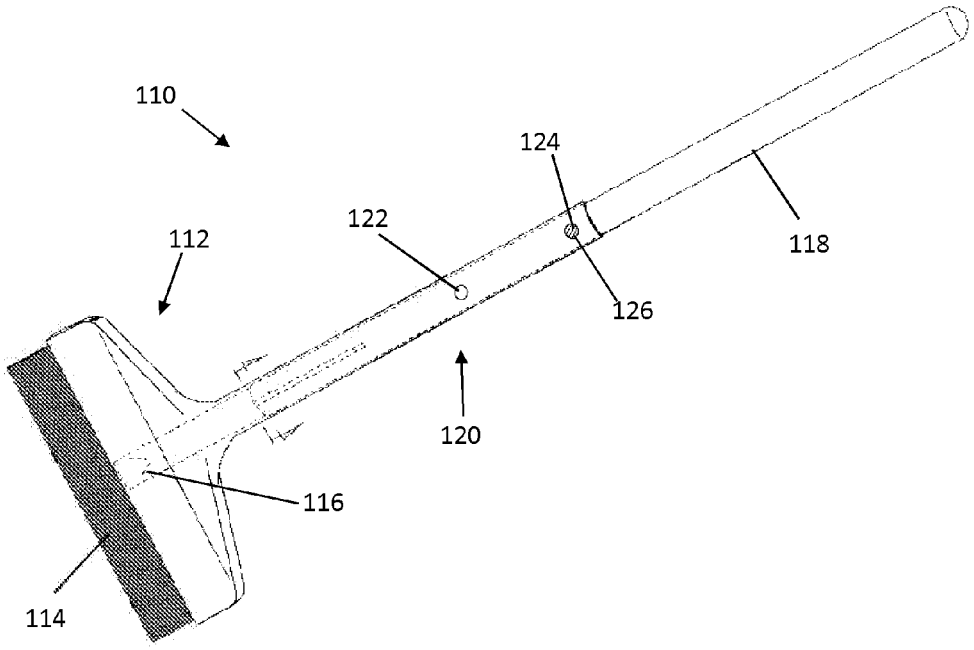
FIGS. 2A and 2B show another embodiment of a scraper broom.
Figure 2B:
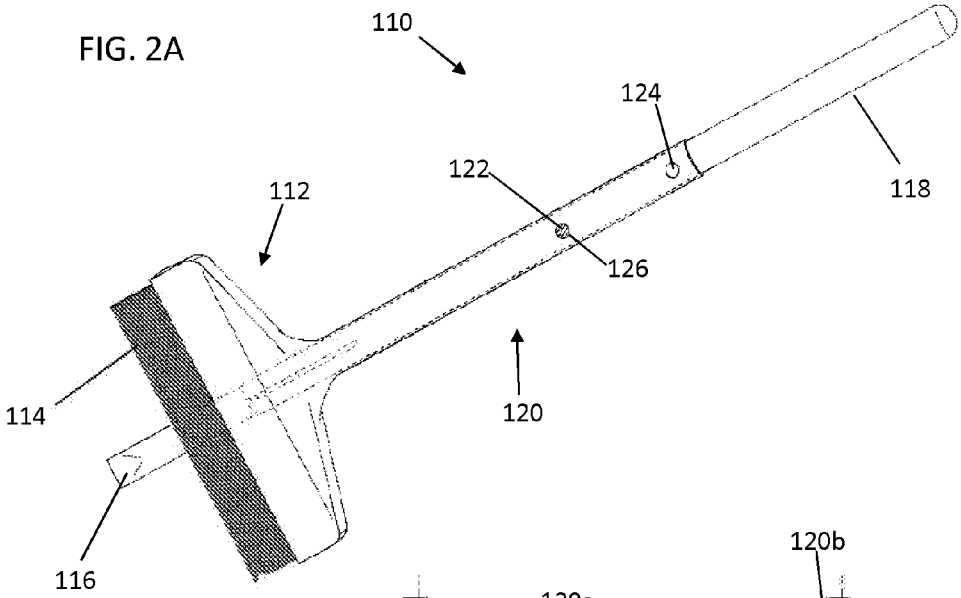

Referring to FIGS. 2A and 2B, a scraper broom 110 is shown that includes a scraper element 116 integral with a handle 118, and including a displaceable broom head 112 having bristles 114 extending therefrom. A neck portion 120 is positioned and configured over a portion of the handle 118. The figures show the displaceable broom head 112 in a first position in which the bristles 114 substantially surround and extend beyond the scraper element 116 (as shown in FIG. 2A) and a second position in which the scraper element 116 is exposed substantially without obstruction from the bristles 114 (as shown in FIG. 2B). The handle includes a locking structure 126 that cooperates with corresponding apertures or structures 122, 124 on the neck portion 120. In certain embodiments, the locking structure 126 includes a spring-loaded button (e.g., as commonly used in telescoping tubes) and elements 122, 124 are suitably dimensioned and configured apertures. Further, these elements can be reversed, e.g., the locking structure on the handle includes one or more apertures and the corresponding structure is a spring-loaded button. In further embodiments, the locking structure is region of magnetic material, and elements 122, 124 are ferrous material (or vice versa, i.e., the locking structure is region of ferrous material, and elements 122, 124 are magnetic material).

Figure 3A:
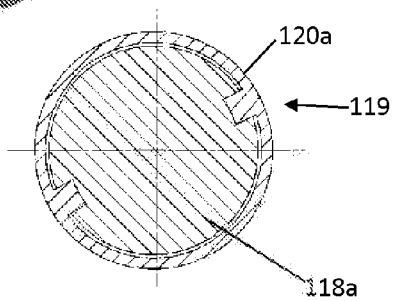
FIGS. 3A and 3B show embodiments of structure features to prevent or minimize the likelihood of the displaceable broom head twisting during use.
Figure 3B:
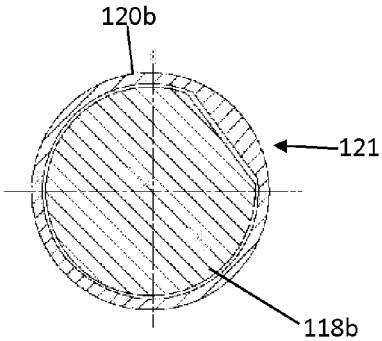

In certain embodiments of the scraper broom described herein, to prevent or minimize the likelihood of the displaceable broom head twisting during use as a broom in the first position or as a scraper in the second position, various structural features can be incorporated. For instance, FIG. 3A shows a pair of groove/ridge anti-twisting structures 119, in which a groove is formed along a portion of the length of handle 118*a*, with corresponding ridges on the inside of the neck portion 120*a*, in which the cross-sectional configuration and dimension of the ridge forms a snug yet slidable fit relative to the corresponding groove. FIG. 3B shows an anti-twisting structure 121 including beveled section along a portion of the length of handle 118*b* with a corresponding feature on the inside of the neck portion 120*b*. Note that the features shown in FIGS. 3A and 3B are not limited to any embodiment of the displaceable or articulating broom head.

Figures 4A, 4B:
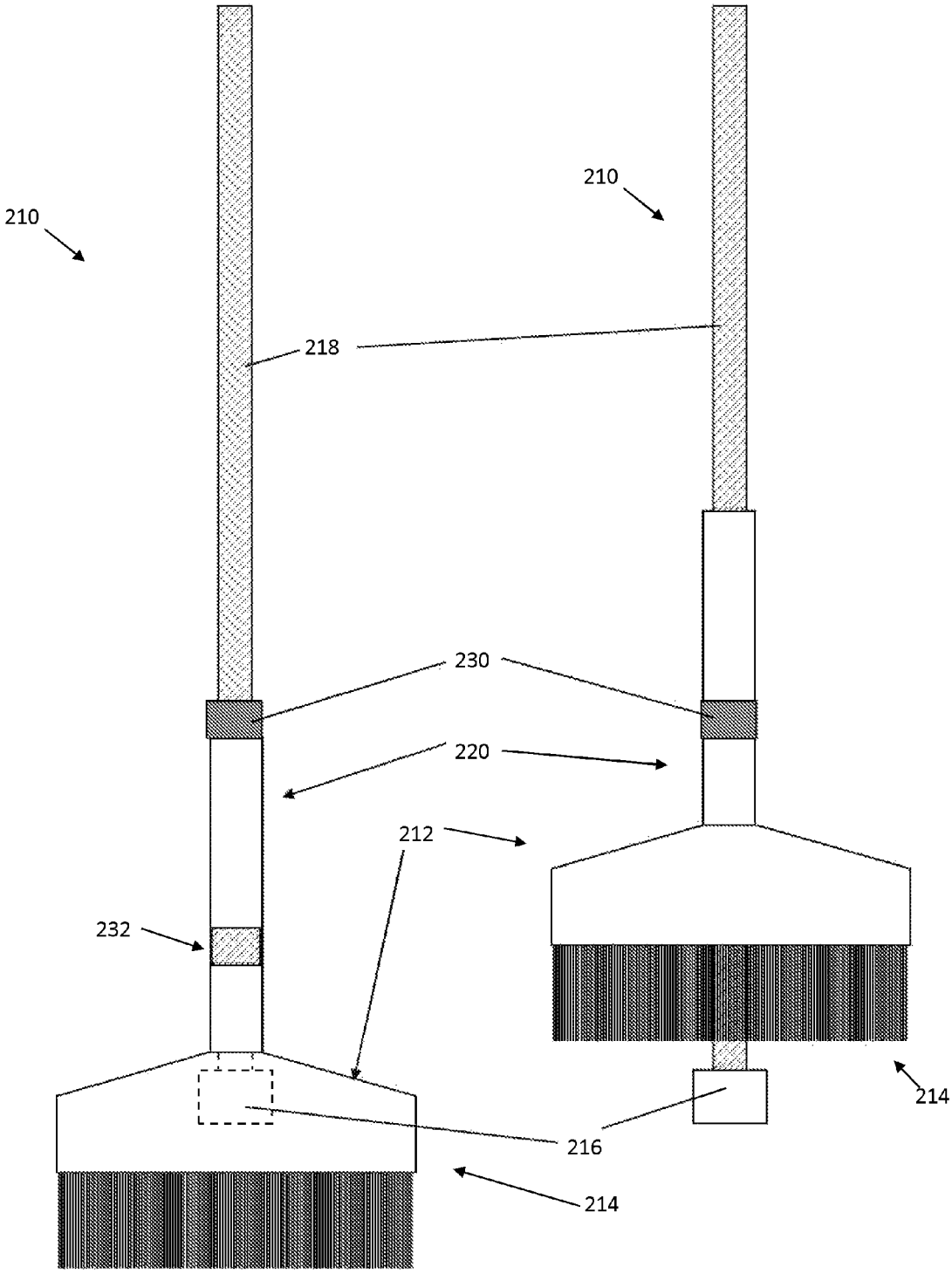
FIGS. 4A-4F show a scraper broom including an embodiment of a locking structure and its use.
Figure 4C:
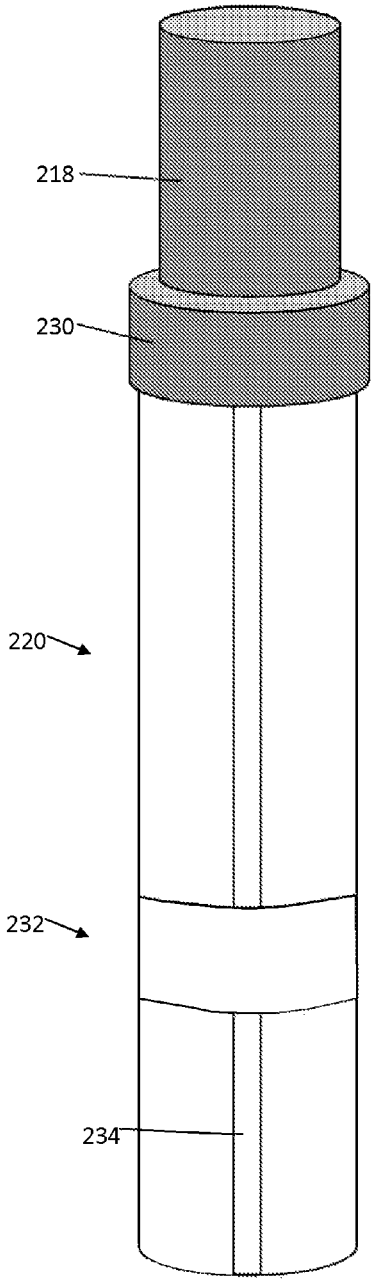

Referring to FIGS. 4A-4F, a scraper broom 210 is shown that includes a scraper element 216 integral with a handle 218, and including a displaceable broom head 212 having bristles 214 extending therefrom. A neck portion 220 is positioned and configured over a portion of the handle 218. The figures show the displaceable broom head 212 in a first position in which the bristles 214 substantially surround and extend beyond the scraper element 216 (as shown in FIG. 4A) and a second position in which the scraper element 216 is exposed substantially without obstruction from the bristles 214 (as shown in FIG. 4B).

Figure 4D:
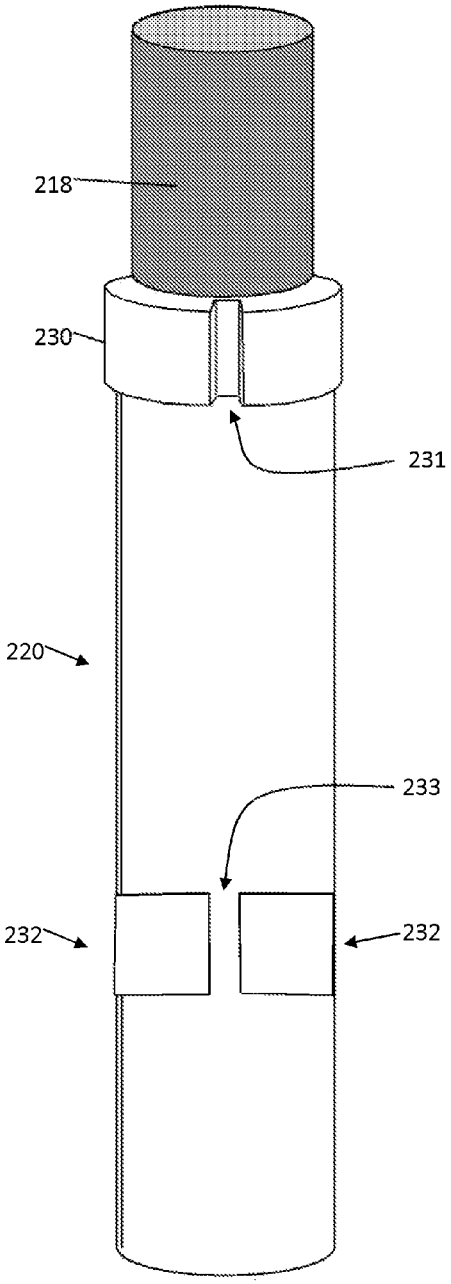
Figure 4E:
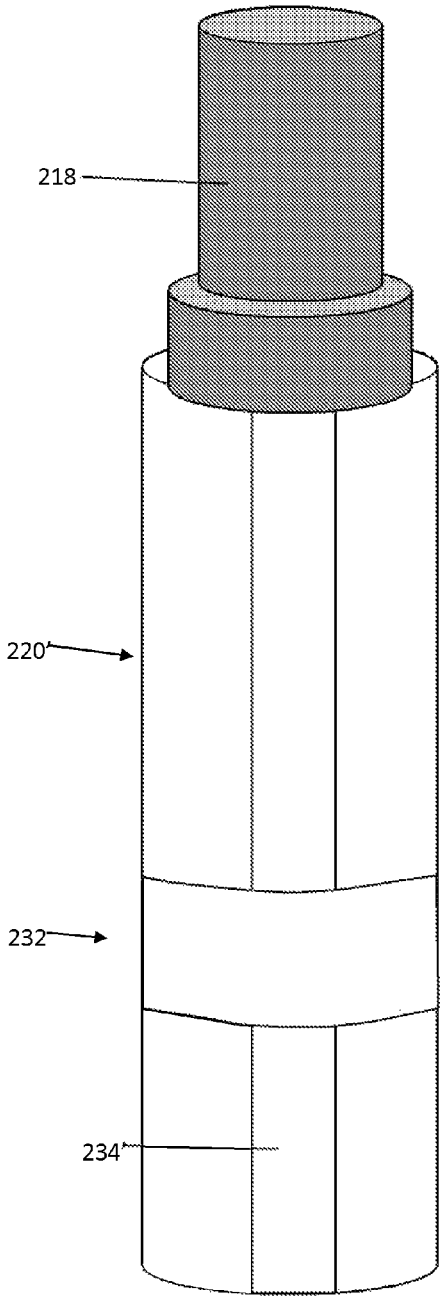
Figure 4F:
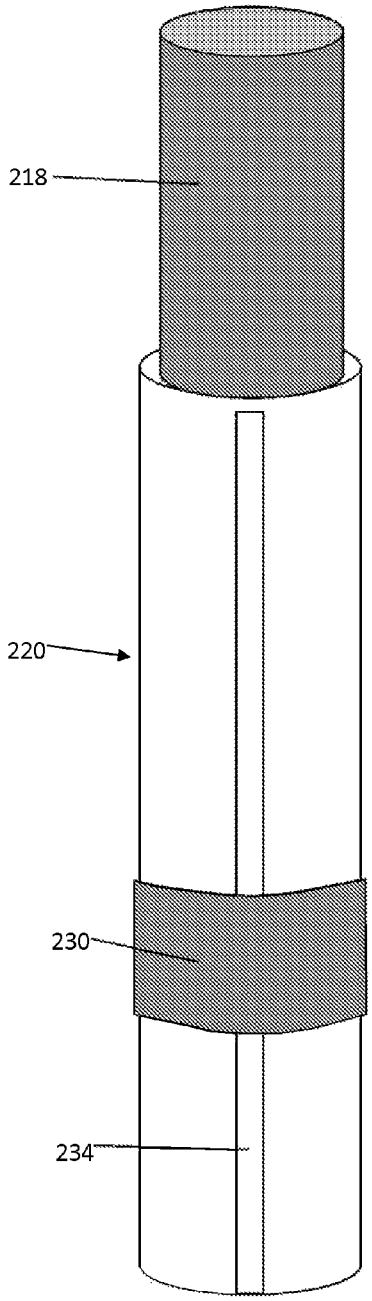

The locking structure described with respect to scraper broom 210 includes a fixed bulge 230 integral with the handle 218 and apertures 232 on the neck portion 220. As shown in FIG. 4D, the bulge 230 includes a groove portion 231 to accommodate the portion 233 of the neck between apertures 232.

In addition, a strip 234 of the neck portion 220 is formed of a suitable elastic material. When the bulge 230 is at the top of neck portion 220, the scraper broom 210 is in its first position. To use the scraper broom 210 as a scraper, the neck portion 220' is expanded by expansion of the strip 234' (FIG. 4E), and the assembly of the neck portion 220 and the displaceable broom head 212 is slid over the bulge 230 until it is received in the apertures 232 (FIG. 4F), thereby fixing the broom head 212 in place above the scraper and exposing the scraper. To return the scraper broom to the first position, the strip 234 is again expanded to slide the bulge 230 back into the position above the neck portion 220.

Note that while a strip 234 is shown along the length of the neck portion 220 (except for the location of the apertures 232), plural expandable elements can be used.

Figures 5A, 5B:
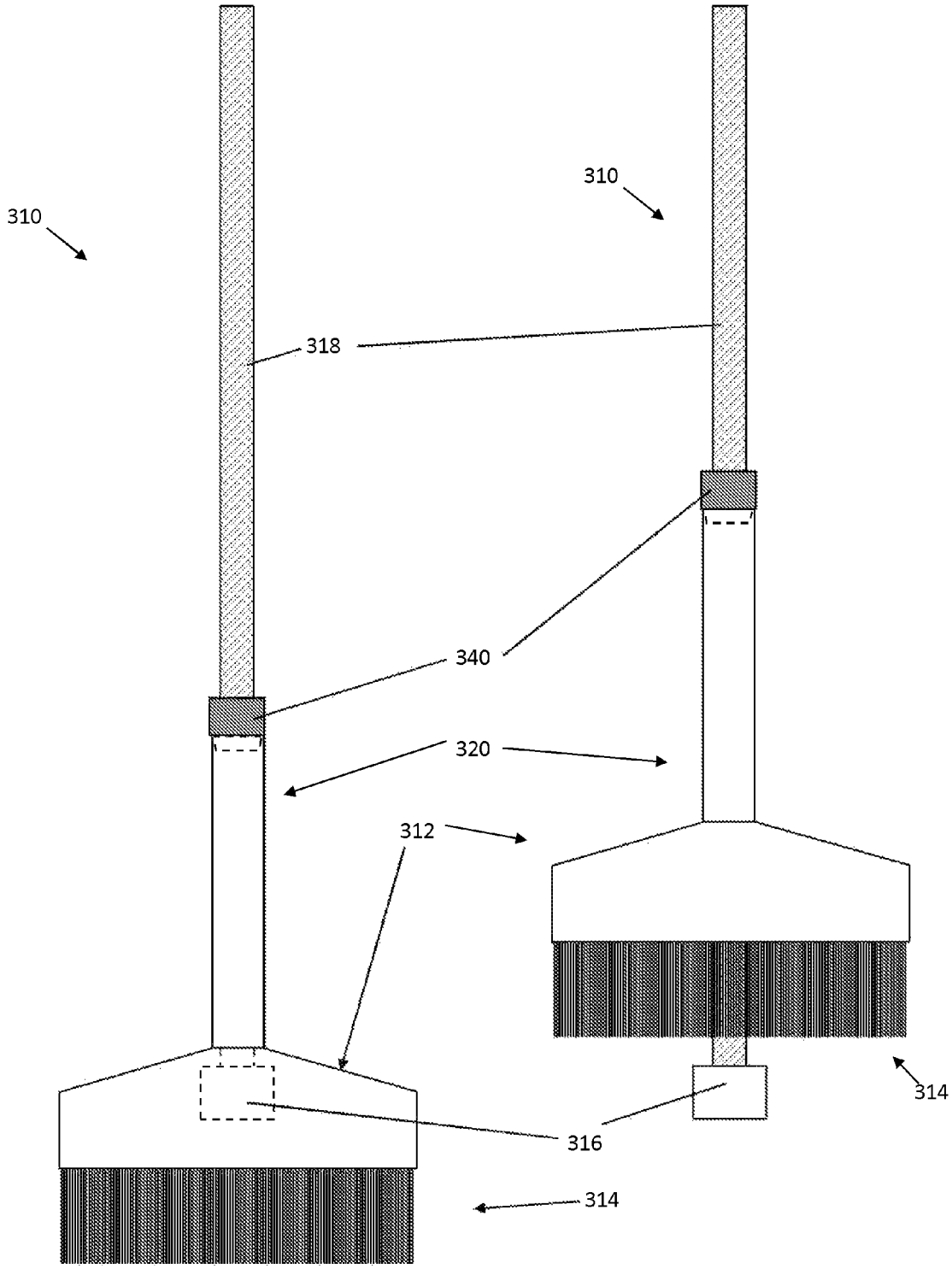
FIGS. 5A-5B show a scraper broom including another embodiment of a locking structure and its use.

Referring to FIGS. 5A and 5B, a scraper broom 310 is shown that includes a scraper element 316 integral with a handle 318, and including a displaceable broom head 312 having bristles 314 extending therefrom. A neck portion 320 that is positioned and configured over a portion of the handle 318. The figures show the displaceable broom head 312 in a first position in which the bristles 314 substantially surround and extend beyond the scraper element 316 (as shown in FIG. 5A) and a second position in which the scraper element 316 is exposed substantially without obstruction from the bristles 314 (as shown in FIG. 5B).

The locking structure described with respect to scraper broom 310 includes a collar 340 positioned on the handle 318 and configured and dimensioned to provide a friction fit between the handle 318 and the neck portion 320. For instance, the collar 340 can be a tapered collar that can be tightly fit in a gap between the top of the neck portion 320 (i.e., the end opposite of the end having the displaceable broom head 312 fixed thereto) by linear force, or by rotational motion, e.g., by locking threads on the collar and the inside of the top of the neck portion. To displace the broom head 312, a user manipulates the tight-fitting collar 340 to loosen it, slides the assemblage of the neck 320 and head 312 (e.g., to the second position as shown in FIG. 5B), and reinserts the collar in the top of the neck portion to provide the friction fit.

Figures 6A, 6B:
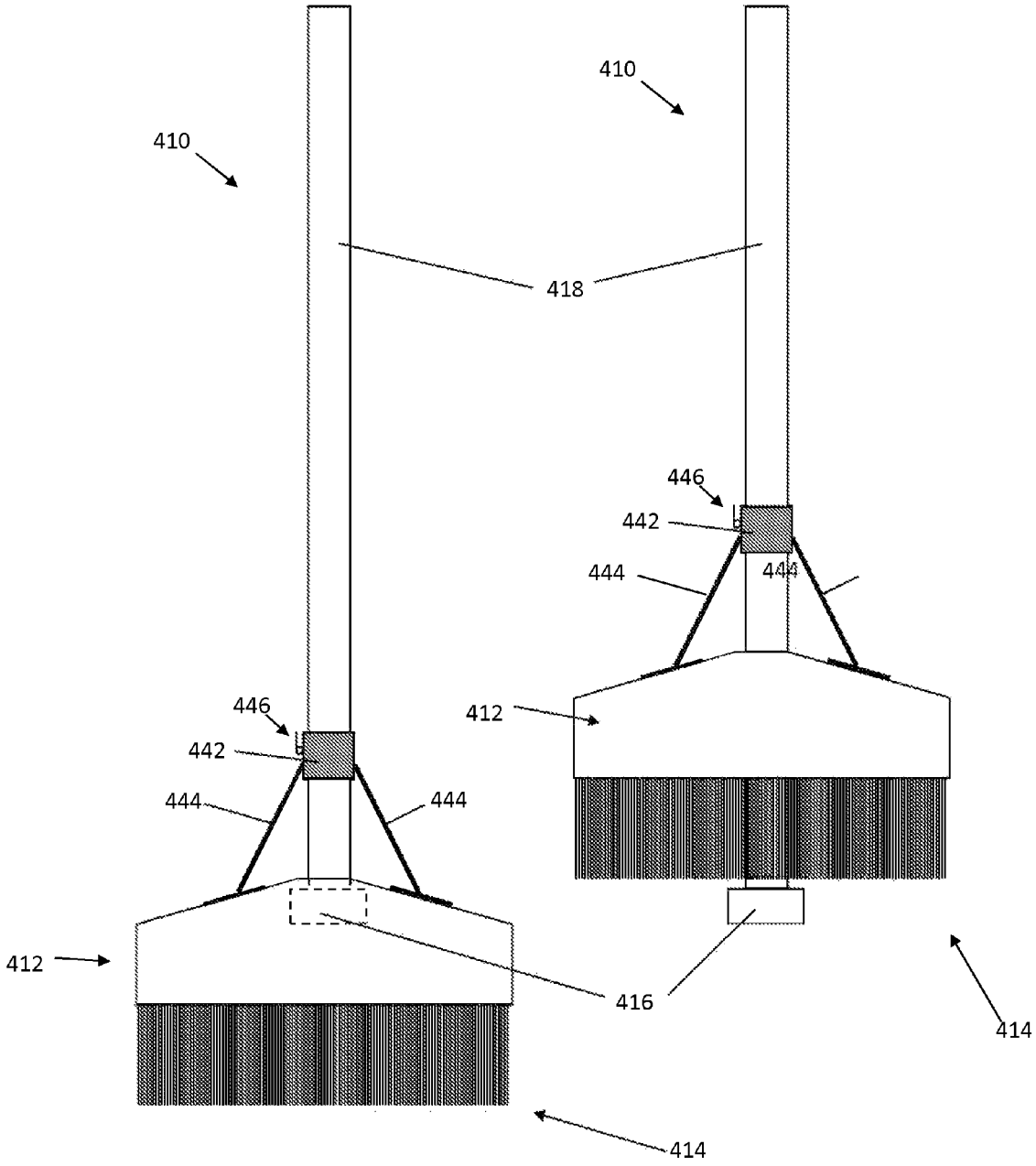
FIGS. 6A-6B show a scraper broom including a further embodiment of a locking structure and its use.

Referring to FIGS. 6A and 6B, a scraper broom 410 is shown that includes a scraper element 416 integral with a handle 418, and including a displaceable broom head 412 having bristles 414 extending therefrom. A locking collar 442 is positioned and configured over a portion of the handle 418. The figures show the displaceable broom head 412 in a first position in which the bristles 414 substantially surround and extend beyond the scraper element 416 (as shown in FIG. 6A) and a second position in which the scraper element 416 is exposed substantially without obstruction from the bristles 414 (as shown in FIG. 6B).

The locking structure described with respect to scraper broom 410 includes a locking collar 442 including connecting members 444 providing a structural attachment between the collar 442 and the top of displaceable broom head 412. Collar 442 can be locked into place with respect to the handle by various structures, such as a lever mechanism 446. When the lever mechanism 446 is manipulated, collar 442 is loosened or tightened, allowing the user to slide the broom head 442 between the first position and the second position.

Figures 7A, 7B:
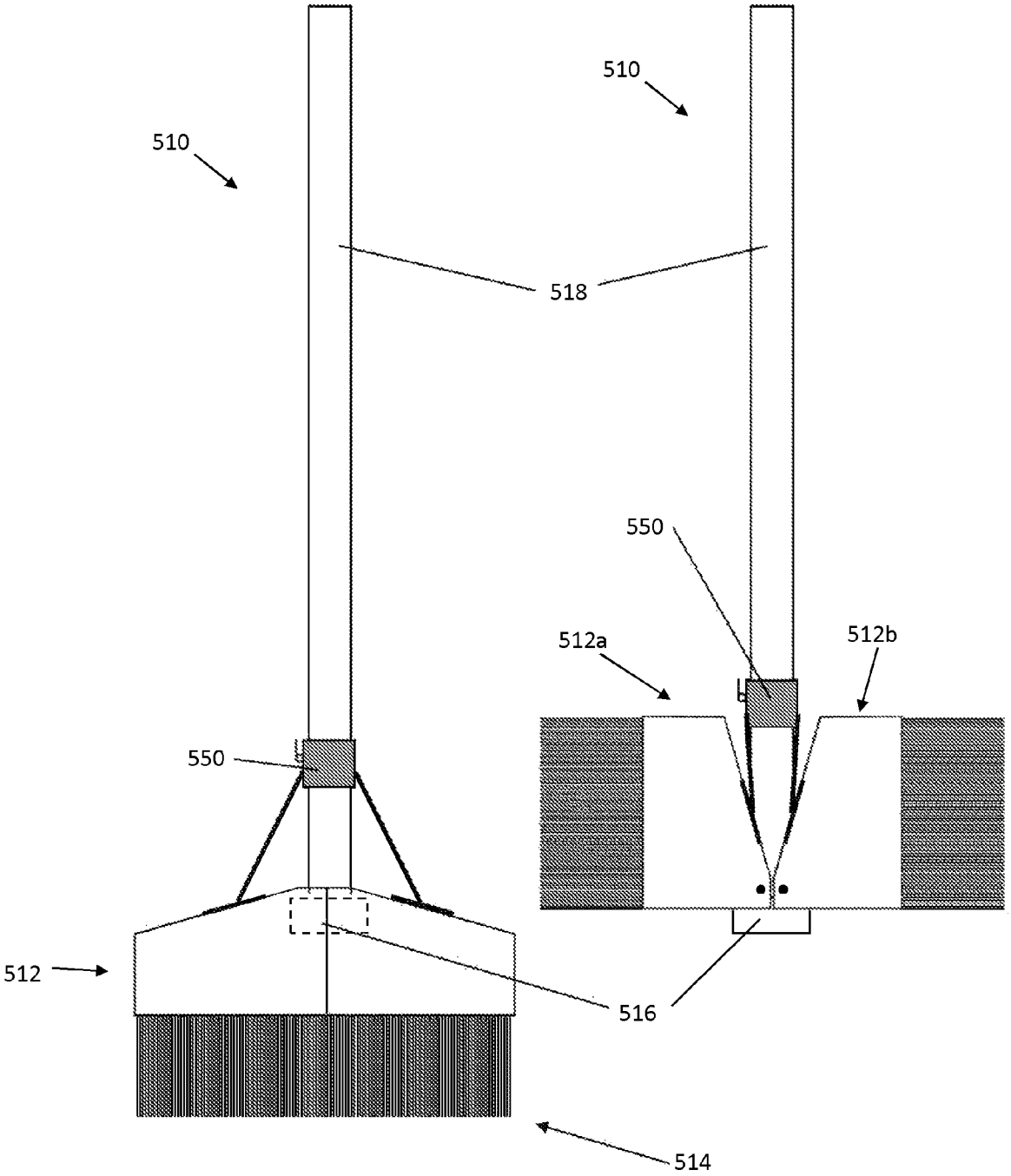
FIGS. 7A-7B show a scraper broom including a further embodiment of a locking structure and its use with plural articulating sections of the broom head.

FIGS. 7A and 7B show another alternative embodiment of a scraper broom. A scraper broom 510 is shown that includes a scraper element 516 integral with a handle 518 and an articulating broom head 512 having bristles 514 extending therefrom and including a locking collar 550 that is positioned and configured over a portion of the handle 518. The figures show the displaceable broom head 512 in a first position in which the bristles 514 substantially surround and extend beyond the scraper element 516 (as shown in FIG. 7A) and a second position in which the scraper element 516 is exposed substantially without obstruction from the bristles 514 (as shown in FIG. 7B) by virtue of the articulation of the broom head. For instance, each of the split broom head structures 512*a* and 512*b* pivot away from one another to expose the scraper 516 as shown in FIG. 7B.

Figures 8A, 8B, 8C:
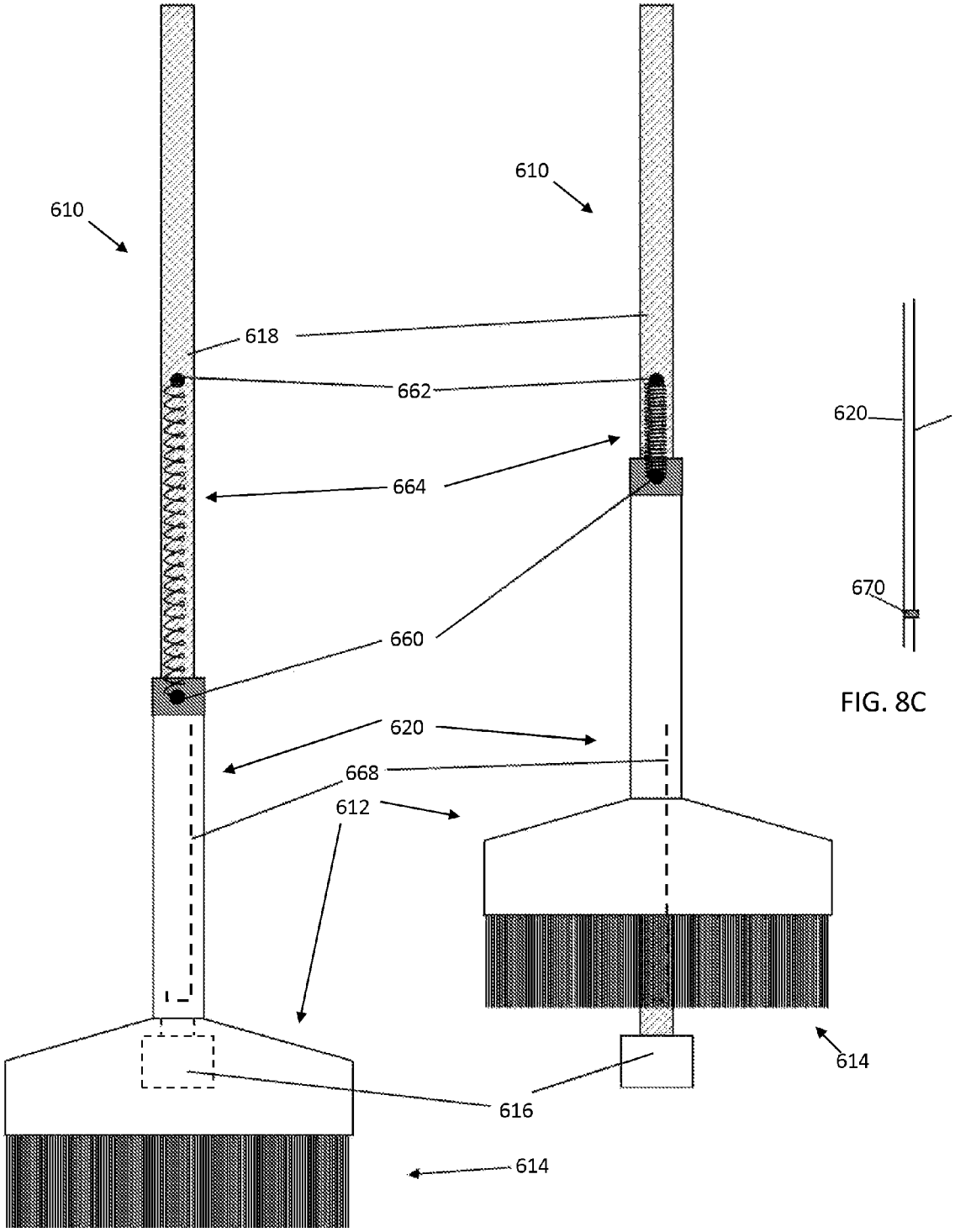
FIGS. 8A-8C show a scraper broom including a spring actuated displacement mechanism.

FIGS. 8A, 8B and 8C show a scraper broom 610 that includes a scraper element 616 integral with a handle 618, and including a displaceable broom head 612 having bristles 614 extending therefrom. A neck portion 620 is positioned and configured over a portion of the handle 618. Scraper broom 610 includes a spring actuated displacement mechanism. As shown in FIGS. 8A and 8B, scraper broom 610 includes a spring 664 positioned between a connection point 662 on the handle 618 and a connection point 660 on the neck portion 620. In addition, an elongated J-shaped aperture or groove 668 is provided on the handle 618, with a structural element 670 (see FIG. 8C) extending from the inside of the neck portion 620 into the groove 668.

The figures show the displaceable broom head 612 in a first position in which the bristles 614 substantially surround and extend beyond the scraper element 616 (as shown in FIG. 8A) and a second position in which the scraper element 616 is exposed substantially without obstruction from the bristles 614 (as shown in FIG. 8B).

In the first position, the element 670 is positioned in the uppermost portion of the hook portion of the J-shaped groove 668 and the spring 664 is extended. The spring forces urge the element 670 against inner edge of the uppermost portion of the hook portion of the J-shaped groove 668 and prevent movement of the broom head 612 unless the spring forces are overcome.

When the broom head 612 is pushed downward and twisted so that the element 670 is away from the hook portion of the J-shaped groove 668, the spring forces pull the broom head upward into the position shown in FIG. 8B, whereby the scraper 616 is exposed.

Note that in certain embodiments, the scraper 616 is at a slight angle relative to the broom head in one of the first or second positions. For instance, in the first position, the scraper (which is hidden from view by the bristles) is rotated slightly, to accommodate locking of element 670 in the hook portion of the J-shaped groove. In the second position, the scraper and the broom head can be substantially parallel.

In addition, certain embodiments using the spring actuated displacement can incorporate a portion of the spring within the handle, whereby a structural element similar to element 670 serves as a spring connection point.

Figures 9A, 9B:
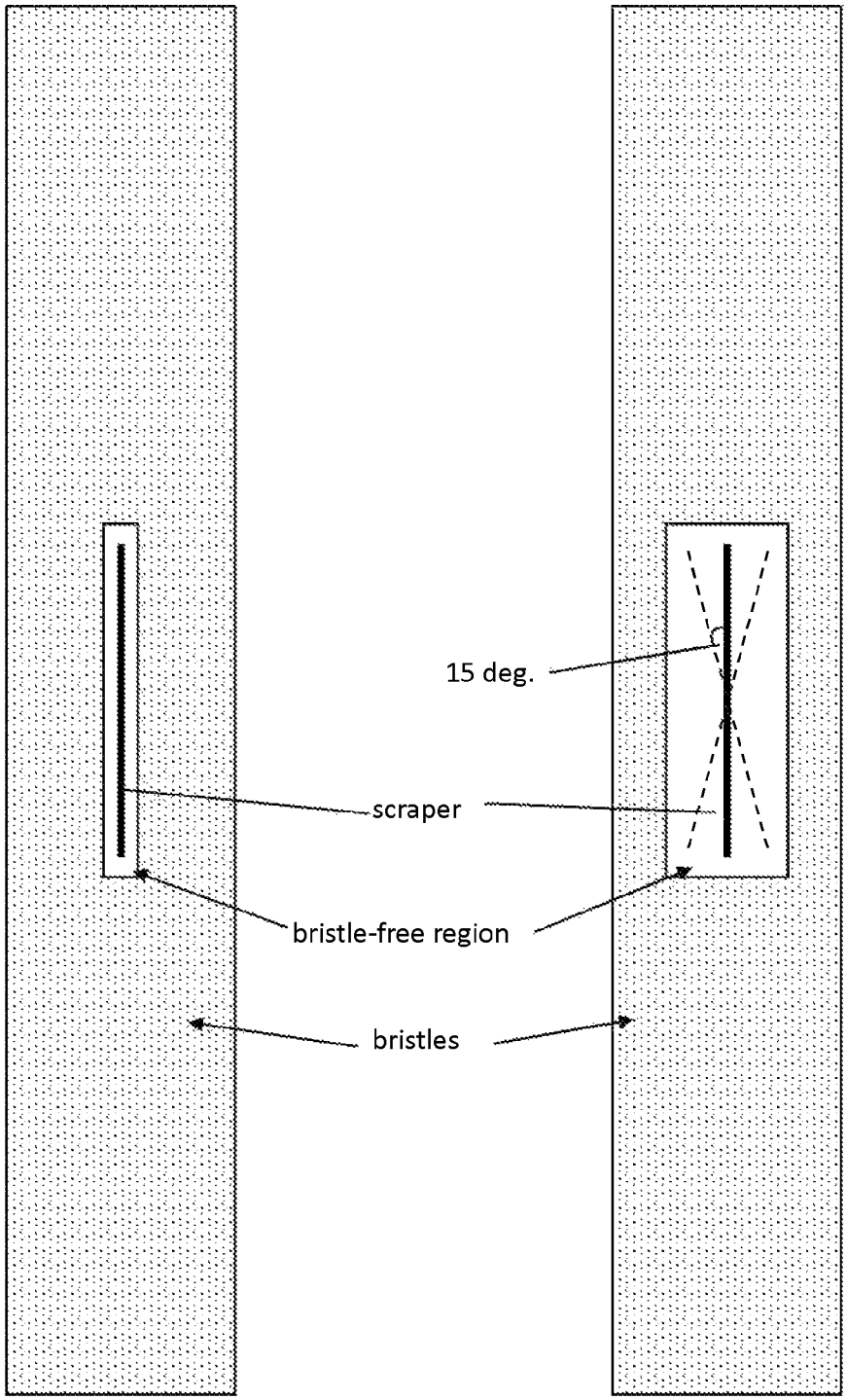
FIGS. 9A through 9D are cross-sectional diagrams of various embodiments of bristle-free regions within the bundle of bristles extending from the broom head.
Figures 9C, 9D:
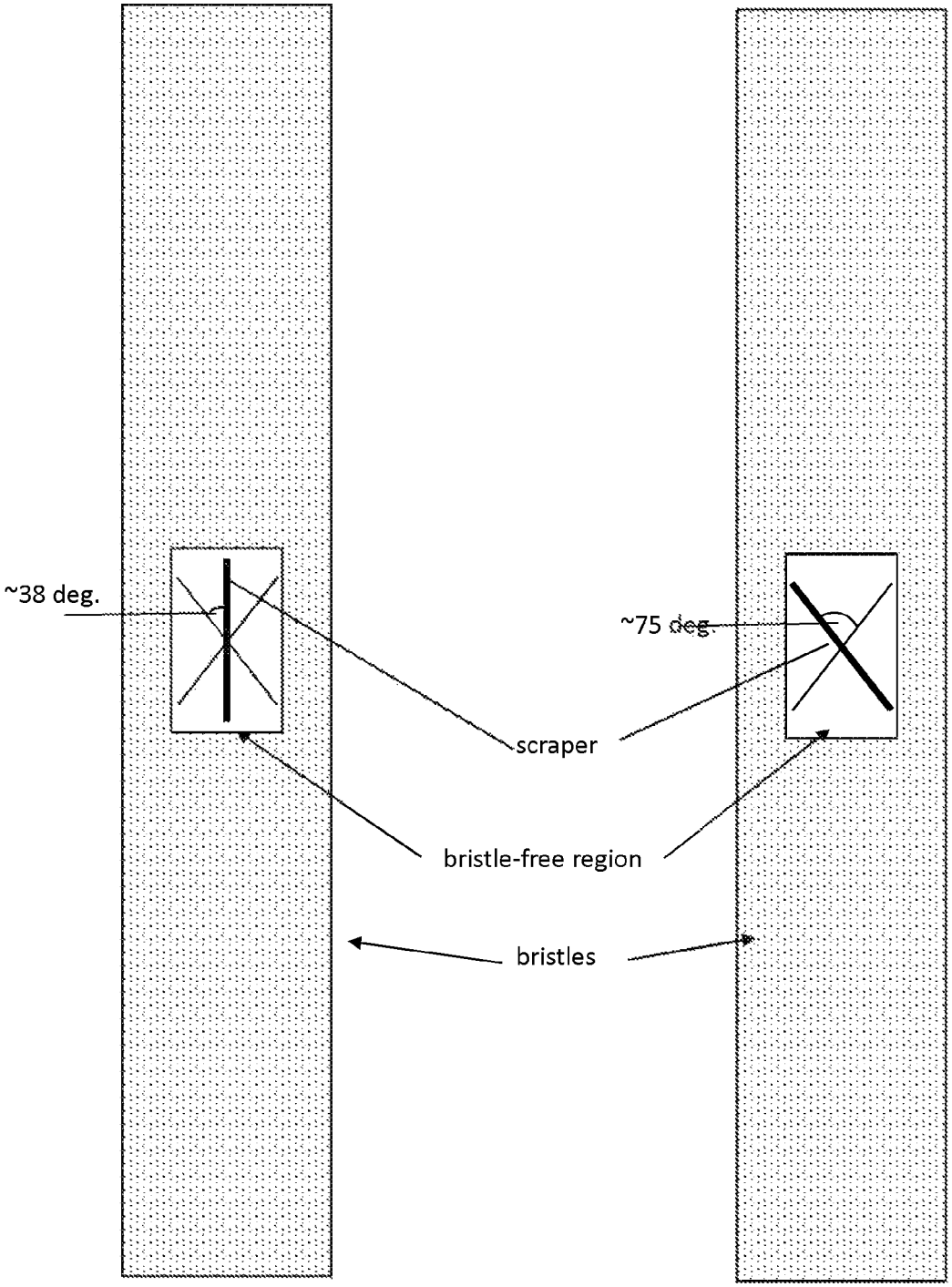

FIGS. 9A through 9D are cross-sectional diagrams of various embodiments of bristle-free regions within the bundle of bristles extending from the broom head. FIG. 9A shows an embodiment suitable for linear motion of the broom head (i.e., sliding up and down a portion of the length of the handle). FIG. 9B shows an embodiment in which the bristle-free region is larger, to accommodate some twisting (e.g., about 15 degrees in either direction), and is suitable for embodiments with linear motion of the broom head or rotational movement of the broom head, preferably up the maximum amount of twisting without damaging the bristles. FIG. 9C is an embodiment in which the width of the scraper is reduced compared to the width in FIGS. 9A and 9B, in which additional rotational twisting is permitted due to the geometry. FIG. 9D is an embodiment in which the scraper is twisted relative to the broom head in its normal position. In any of the embodiments in which twisting is accommodated without damaging the bristles, the locking mechanism can incorporate structures that require twisting of the broom head relative to the handle/scraper assembly.

This invention has been described in detail with reference to specific embodiments thereof, including the best modes for carrying out each embodiment presently known to the inventor. It shall be understood that these illustrations are by way of example and not by way of limitation.

I claim:

1. A scraper broom comprising:

an elongated handle including a scraper element attached at a distal end thereof; and a displaceable broom head having bristles extending therefrom movable between a first position in which the bristles substantially surround and extend beyond the scraper element, and a second position in which the scraper element is exposed substantially without obstruction from the bristles, wherein the broom head comprises plural sections and a locking collar positioned on the handle that is structurally attached to the broom head in a configuration in which, when the collar is locked the plural sections of the broom head are substantially fixed and when the collar is not locked the plural sections of the broom are pivotally displaced to expose the scraper element.

2. The scraper broom as in claim 1, further including a structural feature to minimize the likelihood of the displaceable broom head twisting during use as a broom in the first position or as a scraper in the second position.

3. The scraper broom as in claim 2, wherein the displaceable broom head includes a neck portion, and wherein the structural feature to minimize the likelihood of the displaceable broom head twisting comprises a groove along a portion of the length of the handle and corresponding ridges on the inside of the neck portion.

4. The scraper broom as in claim 2, wherein the displaceable broom head includes a neck portion, and wherein the structural feature to minimize the likelihood of the displaceable broom head twisting comprises a beveled section along a portion of the length of the handle and corresponding feature on the inside of the neck portion.

5. The scraper broom as in claim 1, wherein the broom head includes a bristle-free region proximate the scraper element to accommodate displacement of the broom head without contact between the scraper element and the broom head bristles.

6. A scraper broom comprising:

an elongated handle including a scraper element attached at a distal end thereof; and a displaceable assembly of a broom head and a neck portion, the broom head having bristles extending therefrom, the assembly slidable along a portion of the elongated handle between a first position in which the bristles substantially surround and extend beyond the scraper element, and a second position in which the scraper element is exposed substantially without obstruction from the bristles, the handle including a locking structure that cooperates with one or more corresponding apertures or structures on the broom head neck portion, wherein the locking structure on the handle includes a region of magnetic material and the broom head neck portion includes one or more regions of ferrous material, or the locking structure on the handle includes a region of ferrous material and the broom head neck portion includes one or more regions of magnetic material.

7. The scraper broom as in claim 6, further including a structural feature to minimize the likelihood of the displaceable broom head twisting during use as a broom in the first position or as a scraper in the second position.

8. The scraper broom as in claim 7, wherein the structural feature to minimize the likelihood of the displaceable broom head twisting comprises a groove along a portion of the length of the handle and corresponding ridges on the inside of the neck portion.

9. The scraper broom as in claim 7, wherein the structural feature to minimize the likelihood of the displaceable broom head twisting comprises a beveled section along a portion of the length of the handle and corresponding feature on the inside of the neck portion.

10. The scraper broom as in claim 6, wherein the broom head includes a bristle-free region proximate the scraper element to accommodate displacement of the broom head without contact between the scraper element and the broom head bristles.

11. A scraper broom comprising:

an elongated handle including a scraper element attached at a distal end thereof; and a displaceable assembly of a broom head and a neck portion, the broom head having bristles extending therefrom, the assembly slidable along a portion of the elongated handle between a first position in which the bristles substantially surround and extend beyond the scraper element, and a second position in which the scraper element is exposed substantially without obstruction from the bristles, the handle includes a fixed bulge that cooperates with one or more corresponding apertures on the broom head neck portion; and the broom head neck portion including one or more expandable elements along the length of the neck portion;

wherein expansion of the one or more expandable elements permits passage of the fixed bulge along the neck portion to a position in which the fixed bulge is locked in one of the one or more corresponding apertures, and wherein at least one aperture on the broom head neck portion is positioned such that when the fixed bulge cooperates with that at least one aperture, the the assembly is in the first position.

12. The scraper broom as in claim 11, further including a structural feature to minimize the likelihood of the displaceable broom head twisting during use as a broom in the first position or as a scraper in the second position.

13. The scraper broom as in claim 12, wherein the structural feature to minimize the likelihood of the displaceable broom head twisting comprises a groove along a portion of the length of the handle and corresponding ridges on the inside of the neck portion.

14. The scraper broom as in claim 12, wherein the structural feature to minimize the likelihood of the displaceable broom head twisting comprises a beveled section along a portion of the length of the handle and corresponding feature on the inside of the neck portion.

15. The scraper broom as in claim 11, wherein the broom head includes a bristle-free region proximate the scraper element to accommodate displacement of the broom head without contact between the scraper element and the broom head bristles.

* * * * *